US008807285B2

(12) United States Patent
Kugiya et al.

(10) Patent No.: US 8,807,285 B2
(45) Date of Patent: Aug. 19, 2014

(54) ELEVATOR DEVICE AND METHOD OF INSPECTING SAME

(75) Inventors: Takuo Kugiya, Tokyo (JP); Hiroshi Kigawa, Tokyo (JP); Masunori Shibata, Tokyo (JP); Rikio Kondo, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 541 days.

(21) Appl. No.: 13/142,868

(22) PCT Filed: Dec. 15, 2009

(86) PCT No.: PCT/JP2009/070896

§ 371 (c)(1),
(2), (4) Date: Jun. 30, 2011

(87) PCT Pub. No.: WO2010/100802

PCT Pub. Date: Sep. 10, 2010

(65) Prior Publication Data

US 2011/0272216 A1 Nov. 10, 2011

(30) Foreign Application Priority Data

Mar. 4, 2009 (JP) ..... 2009-050510

(51) Int. Cl.
*B66B 1/36* (2006.01)
*B66B 13/22* (2006.01)
*B66B 5/00* (2006.01)

(52) U.S. Cl.
CPC ..... *B66B 5/0031* (2013.01); *B66B 13/22* (2013.01)
USPC ..... 187/301

(58) Field of Classification Search
CPC ..... B66B 1/48; B66B 1/36
USPC ..... 187/391, 393, 317, 301, 302
See application file for complete search history.

(56) References Cited

U.S. PATENT DOCUMENTS 6,173,814 B1 * 1/2001 Herkel et al. ..... 187/288
8,552,738 B2 * 10/2013 Quinn ..... 324/549

(Continued)

FOREIGN PATENT DOCUMENTS

DE 600 29 312 T2 7/2007
EP 1 159 218 B1 7/2006

(Continued)

OTHER PUBLICATIONS

International Search Report issued Mar. 16, 2010 in PCT/JP09/070896 filed Dec. 15, 2009.

(Continued)

*Primary Examiner* — Michael Mansen
*Assistant Examiner* — Diem Tran
(74) *Attorney, Agent, or Firm* — Oblon, Spivak, McClelland, Maier & Neustadt, L.L.P.

(57) ABSTRACT

In an elevator apparatus, an operation control section controls an operation of a car. Further, a safety monitoring section detects an abnormal state of targets to be monitored during running of the car to stop the running of the car. A safety-monitoring-function inspection section inspects a function of the safety monitoring section. The safety-monitoring-function inspection section causes the safety monitoring section to detect a transition of a state of the targets to be monitored to the abnormal state regardless of an actual state of the targets to be monitored while the car is running under control of the operation control section.

6 Claims, 15 Drawing Sheets

(56) References Cited

U.S. PATENT DOCUMENTS

| | | | | |
|---|---|---|---|---|
| 2003/0192746 | A1* | 10/2003 | Suzuki | 187/391 |
| 2007/0007087 | A1 | 1/2007 | Matsuoka | |
| 2010/0155184 | A1* | 6/2010 | Sirigu et al. | 187/302 |

FOREIGN PATENT DOCUMENTS

| | | | |
|---|---|---|---|
| JP | 63 167461 | | 11/1988 |
| JP | 08-012214 | A | 1/1996 |
| JP | 10 157955 | | 6/1998 |
| JP | 2007 55691 | | 3/2007 |
| JP | 2007 223730 | | 9/2007 |
| WO | 2005 082765 | | 9/2005 |
| WO | 2008 068840 | | 6/2008 |

OTHER PUBLICATIONS

Office Action issued Sep. 25, 2012 in Korean Patent Application No. 10-2011-7019488 with English language translation.
German Office Action issued Oct. 19, 2012 in Patent Application No. 11 2009 004 592.8 with English Translation.
U.S. Appl. No. 13/376,643, filed Dec. 7, 2011, Kondo, et al.

* cited by examiner

ELEVATOR DEVICE AND METHOD OF INSPECTING SAME

TECHNICAL

The present invention relates to an elevator apparatus including a safety monitoring section for detecting an abnormal state of a target to be monitored during running of a car so as to stop the running of the car, and relates to an inspection method of inspecting a function of the safety monitoring section.

BACKGROUND

With a conventional device for preventing a car from starting with a door open for an elevator, when a car position moves out of a landing zone with a door open, a car re-leveling operation is performed by car-position correction means. When a difference between the car position when the door is open and the car position after the correction operation is performed by the car-position correction means exceeds a predetermined value, a main rope is gripped by a rope gripper. As a result, the start of the car with the door open can be detected before the car moves out of the door zone. Therefore, a running distance of the car from the start of the car with the door open to a point where a braking operation is performed to stop the car can be further reduced (for example, see Patent Literature 1).

CITATION LIST

Patent Literature

[PTL 1] JP 2007-55691 A

SUMMARY OF INVENTION

Technical Problem

In a conventional elevator, however, in order to confirm a normal operation of an unintended car movement protection device at the time of inspection, it is necessary to cause the car to run and to open a car door or a landing door while the car is running in an area other than the door zone. Therefore, a worker who carries out the inspection is required to determine door-open timing with meticulous attention based on a position and a speed at which the car runs, which disadvantageously becomes a factor of lowered operation efficiency.

The present invention has been made to solve the problem described above, and therefore has an object to provide an elevator apparatus and a method of inspecting the same, which enable an easy inspection of a safety monitoring section.

Solution to Problem

An elevator apparatus according to the present invention includes: a car; an operation control section for controlling an operation of the car; a safety monitoring section for detecting an abnormal state of targets to be monitored during running of the car to stop the running of the car; and a safety-monitoring-function inspection section for inspecting a function of the safety monitoring section, in which: the safety-monitoring-function inspection section causes the safety monitoring section to detect a transition of a state of the targets to be monitored to the abnormal state regardless of an actual state of the targets to be monitored while the car is running under control of the operation control section.

Further, an elevator apparatus according to the present invention includes: a car; opening/closing detection means for detecting opening/closing of landing doors; an unintended car movement protection device, connected to the opening/closing detection means, for stopping running of the car when detecting the running of the car with at least any one of the landing doors open; and door-open recognition means for inspection, for causing the unintended car movement protection device to detect that at least one of the landing doors is opened during the running of the car even though all the landing doors are closed.

Further, the present invention provides a method of inspecting an elevator apparatus. The elevator apparatus includes: a car; an operation control section for controlling an operation of the car; and an unintended car movement protection device, for stopping running of the car when at least any one of elevator doors is open. The method includes: causing the unintended car movement protection device to detect with a safety-monitoring-function inspection section that at least one of the elevator doors is opened in a state in which all the elevator doors are closed while the car is running under control of the operation control section.

Advantageous Effects of Invention

The safety-monitoring-function inspection section of the elevator apparatus of the present invention causes the safety monitoring section to detect the transition of the state of the targets to be monitored to the abnormal state regardless of the actual state of the targets to be monitored while the car is running under the control of the operation control section. Therefore, it is not necessary to actually place the targets to be monitored into the abnormal state while the car is running under the control. As a result, the inspection of the safety monitoring section can be easily carried out.

Moreover, the door-open recognition means for inspection causes the unintended car movement protection device to detect that at least one of the landing doors is opened even though all the landing doors are closed while the car is running. Therefore, it is not necessary to actually open any one of the landing doors which correspond to the targets to be monitored while the car is running under the control. As a result, the inspection of the safety monitoring section can be easily carried out.

Further, with the method of inspecting the elevator apparatus according to the present invention, the safety-monitoring-function inspection section causes the unintended car movement protection device to detect that at least one of the elevator doors is opened in the state in which all the elevator doors are closed while the car is running under the control of the operation control section. Therefore, it is not necessary to actually open any one of the landing doors corresponding to the targets to be monitored while the car is running under the control. As a result, the inspection of the safety monitoring section can be easily carried out.

DESCRIPTION OF EMBODIMENTS

Figure 1:
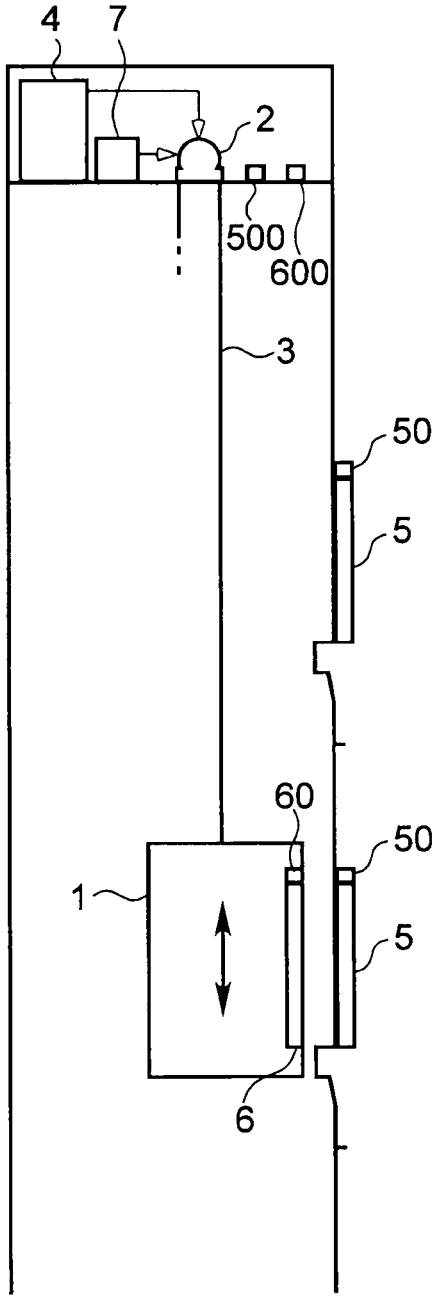
FIG. 1 is a schematic configuration diagram illustrating an elevator apparatus according to Embodiment 1 of the present invention.

Hereinafter, embodiments for carrying out the present invention are described referring to the drawings.

Embodiment 1

FIG. 1 is a schematic configuration diagram illustrating an elevator apparatus according to Embodiment 1 of the present invention. In FIG. 1, a car 1 and a counterweight (not shown) are suspended in a hoistway by suspension means 3, and are raised and lowered in the hoistway by a driving force of a hoisting machine 2. As the suspension means 3, a plurality of ropes or a plurality of belts are used.

The hoisting machine 2 is provided in an upper part of the hoistway. The hosting machine 2 includes a driving sheave around which the suspension means 3 is looped, a hoisting-machine motor for rotating the driving sheave, and a hoisting-machine brake for braking the rotation of the driving sheave.

The hoisting-machine brake includes a brake drum connected coaxially to the driving sheave, brake shoes to be brought into contact with and separated away from the brake drum, a brake spring for pressing the brake shoes against the brake drum to apply a braking force thereto, and an electromagnetic magnet for separating the brake shoes away from the brake drum against the brake spring to release the braking force.

The hoisting machine 2 is controlled by an operation controller 4 corresponding to an operation control section. Specifically, an operation of the car 1 is controlled by the operation controller 4. The operation controller 4 is provided in the upper part of the hoistway in the vicinity of the hoisting machine 2.

A landing door 5 corresponding to an elevator door for opening and closing a landing doorway is provided to a landing of each stop floor. A car door 6 corresponding to an elevator door for opening and closing a car doorway is provided to the car 1. A door driving device for opening and closing the car door 6 is mounted to the car 1. The door driving device is controlled by the operation controller 4. In other words, the opening/closing of the car door 6 is controlled by the operation controller 4. Each of the landing doors 5 is engaged with the car door 6 to be opened and closed interlockingly with the car door 6.

A landing-door opening/closing detection device 50 corresponding to opening/closing detection means for detecting the opening/closing of the corresponding landing door 5 is provided to each landing. A car-door opening/closing detection device 60 corresponding to opening/closing detection means for detecting the opening/closing of the car door 6 is provided to the car 1. The opening/closing of the landing doors 5 and the car door 6 is allowed when the car 1 is present within a predetermined area in the vicinity of a landing floor, that is, within a door zone.

In the upper part of the hoistway, a unintended car movement protection device 7 corresponding to a safety monitoring section is provided. The unintended car movement protection device 7 stops the running of the car 1 while at least one of the landing doors 5 and the car door 6 is open. The unintended car movement protection device 7 also stops the running of the car 1 when at least one of the landing doors 5 and the car door 6 is opened while the car 1 is present within an area out of the door zone.

Further, when the abnormal state as described above is detected, the unintended car movement protection device 7 interrupts the supply of electric power to the hoisting-machine motor and causes the hoisting-machine brake to perform the braking operation to stop the running of the car 1.

A landing-side inspection device 500 and a car-side inspection device 600, each corresponding to a safety-monitoring-function inspection section for inspecting a function of the unintended car movement protection device 7, are connected to the unintended car movement protection device 7.

Figure 2:
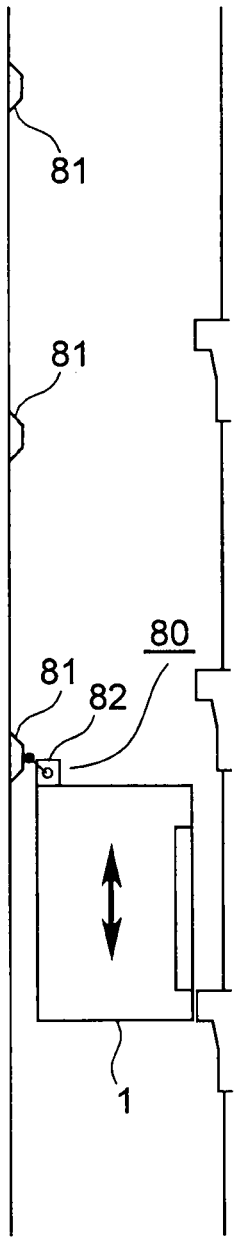
FIG. 2 is a configuration diagram illustrating a door-zone detection device of the elevator apparatus illustrated in FIG. 1.

FIG. 2 is a configuration diagram illustrating a door-zone detection device of the elevator apparatus illustrated in FIG. 1. In FIG. 2, a door-zone detection device 80 corresponding to car-position detection means includes a plurality of door-zone detection plates 81 provided at positions inside the hoistway, which correspond to the door zone, and a door-zone detection switch 82 mounted on the car 1, which is to be operated by the door-zone detection plates 81. The door-zone detection switch 82 is brought into contact with the door-zone detection plates 81 only when the car 1 is present within the door zone. As a result, whether or not the car 1 is present within the door zone is detected.

Figure 3:
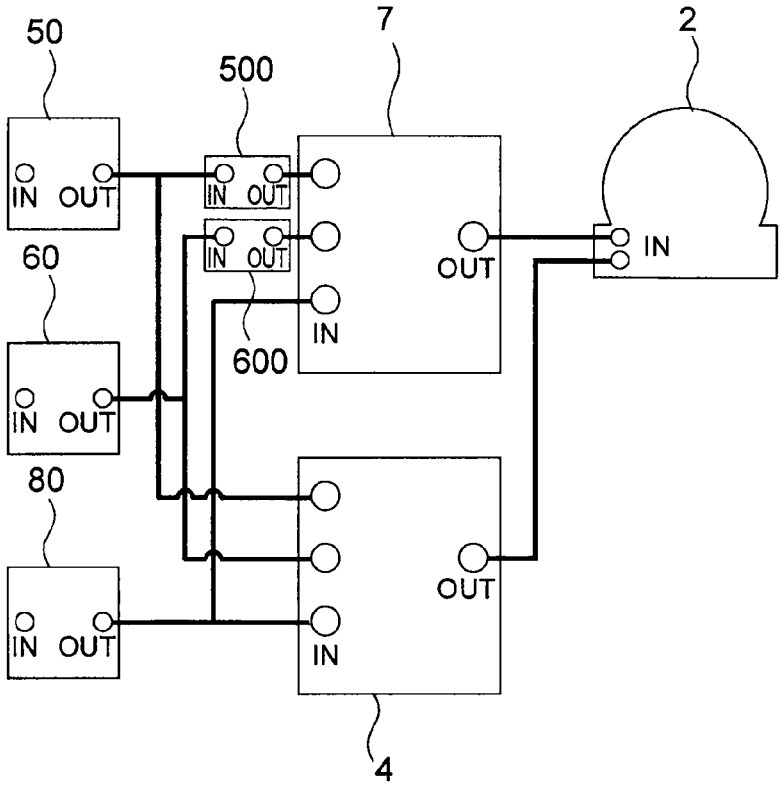
FIG. 3 is a wiring diagram illustrating a state in which devices are electrically connected in the elevator apparatus illustrated in FIG. 1.

FIG. 3 is a wiring diagram illustrating a state in which the devices are electrically connected in the elevator apparatus illustrated in FIG. 1. In FIG. 3, the operation controller 4 is connected to the landing-door opening/closing detection device 50, the car-door opening/closing detection device 60, the door-zone detection device 80, and the hoisting machine 2. In this manner, the operation controller 4 is capable of detecting the open/closed states of the landing doors 5 and the car door 6 and the position of the car 1 (whether or not the car 1 is present within the door zone).

The operation controller 4 opens and closes the landing doors 5 and the car door 6 after confirming the presence of the car 1 within the door zone. Further, the operation controller 4 operates the hoisting machine 2 to allow the car 1 to run to a target floor after confirming the full closure of the landing doors 5 and the car door 6.

The unintended car movement protection device 7 is connected to the landing-door opening/closing detection device 50 through an intermediation of the landing-side inspection device 500. The unintended car movement protection device 7 is connected to the car-door opening/closing detection device 60 through an intermediation of the car-side inspection device 600. Further, the unintended car movement protection device 7 is connected to the door-zone detection device 80 and the hoisting machine 2. As a result, the unintended car movement protection device 7 is capable of detecting the open/closed states of the landing doors 5 and the car door 6 and the position of the car 1 (whether or not the car 1 is present within the door zone) independently of the operation controller 4.

When it is detected that at least any one of the landing doors 5 and the car door 6 is open while the car 1 is present within the area out of the door zone, the unintended car movement protection device 7 outputs a command for causing the hoisting-machine brake to perform the braking operation to the hoisting machine 2.

The landing-side inspection device 500 and the car-side inspection device 600 are operated by a worker who carries out an inspection when the function of the unintended car movement protection device 7 is to be inspected. When being operated by the worker, the landing-side inspection device 500 causes the unintended car movement protection device 7 to detect that at least one of the landing doors 5 is opened regardless of actual open/closed states of the landing doors 5, that is, even though all the landing doors 5 are closed.

Similarly, when being operated by the worker, the car-side inspection device 600 causes the unintended car movement protection device 7 to detect that the car door 6 is opened regardless of an actual open/closed state of the car door 6, that is, even though the car door 6 is closed. As a result, the function of the unintended car movement protection device 7 can be confirmed without actually opening the landing doors 5 and the car door 6 while the car 1 is running under the control.

Figure 4:
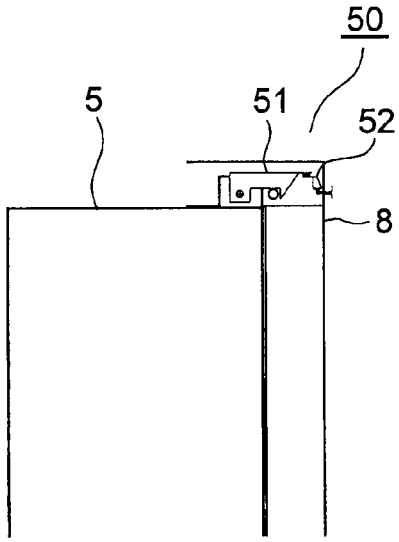
FIG. 4 is a front view illustrating a landing-door opening/closing detection device illustrated in FIG. 1.
Figure 5:
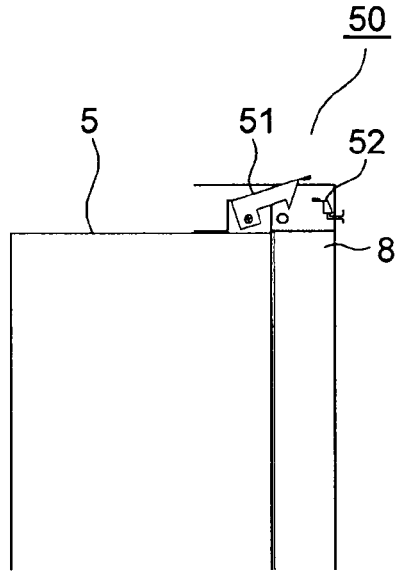
FIG. 5 is a front view illustrating a state immediately before start of an opening operation of a landing door illustrated in FIG. 4.
Figure 6:
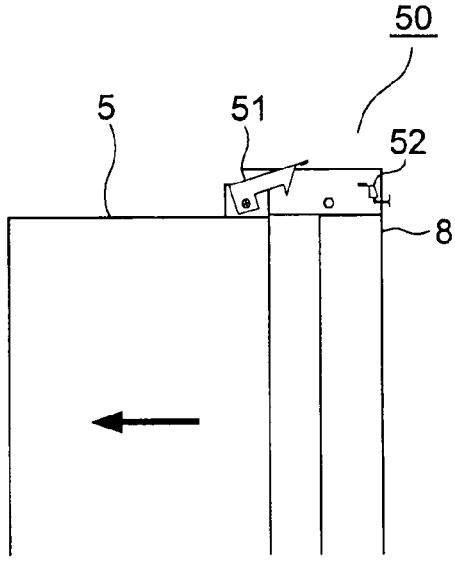
FIG. 6 is a front view illustrating a state in which the opening operation of the landing door illustrated in FIG. 4 is being performed.

FIG. 4 is a front view illustrating the landing-door opening/closing detection device 50 illustrated in FIG. 1, FIG. 5 is a front view illustrating a state immediately before start of an opening operation of the landing door 5 illustrated in FIG. 4, and FIG. 6 is a front view illustrating a state in which the opening operation of the landing door 5 illustrated in FIG. 4 is being performed. In FIGS. 4 to 6, a landing-door lock mechanism 51 for mechanically connecting the landing door 5 to a jamb 8 so as to prevent the landing door 5 from being unintentionally opened is provided to the top of the landing door 5. The landing-door lock mechanism 51 is brought into a locked state as illustrated in FIG. 4 when the landing door 5 is fully closed, and is unlocked as illustrated in FIGS. 5 and 6 only when the landing door 5 is to be opened.

A landing-door interlock switch 52 corresponding to a door switch is provided between the jamb 8 and the landing-door lock mechanism 51. The landing-door interlock switch 52 is closed to be brought into an energized state only when the landing-door lock mechanism 51 is locked, and is opened to be brought into a de-energized state when the landing-door lock mechanism 51 is unlocked. The landing-door opening/closing detection device 50 includes the landing-door lock mechanism 51 and the landing-door interlock switch 52.

Figure 7:
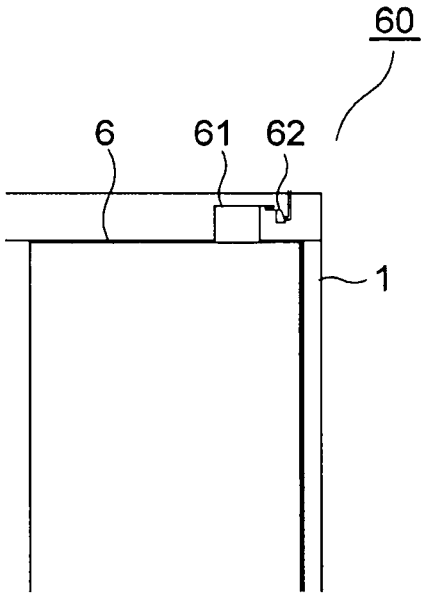
FIG. 7 is a front view illustrating a car-door opening/closing detection device illustrated in FIG. 1.
Figure 8:
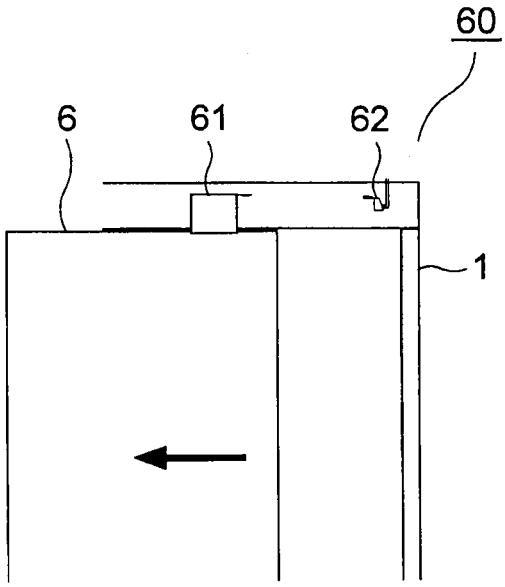
FIG. 8 is a front view illustrating a state in which an opening operation of a car door illustrated in FIG. 7 is being performed.

FIG. 7 is a front view illustrating the car-door opening/closing detection device 60 illustrated in FIG. 1, and FIG. 8 is a front view illustrating a state in which an opening operation of the car door 6 illustrated in FIG. 7 is being performed. In FIGS. 7 and 8, a car-door interlocking contact 61 is provided on the top of the car door 6. A car-door interlock switch 62 corresponding to a door switch is provided to an upper part of the car doorway.

As illustrated in FIG. 7, when the car door 6 is fully closed, the car-door interlocking contact 61 is held in contact with the car-door interlock switch 62 to close and bring the car-door interlock switch 62 into the energized state. On the other hand, when the car door 6 is opened even slightly as illustrated in FIG. 8, the car-door interlocking contact 61 is configured to be separated away from a contact of the car-door interlock switch 62 to open and bring the car-door interlock switch 62 into the de-energized state. The car-door opening/closing detection device 60 includes the car-door interlocking contact 61 and the car-door interlock switch 62.

Figure 9:
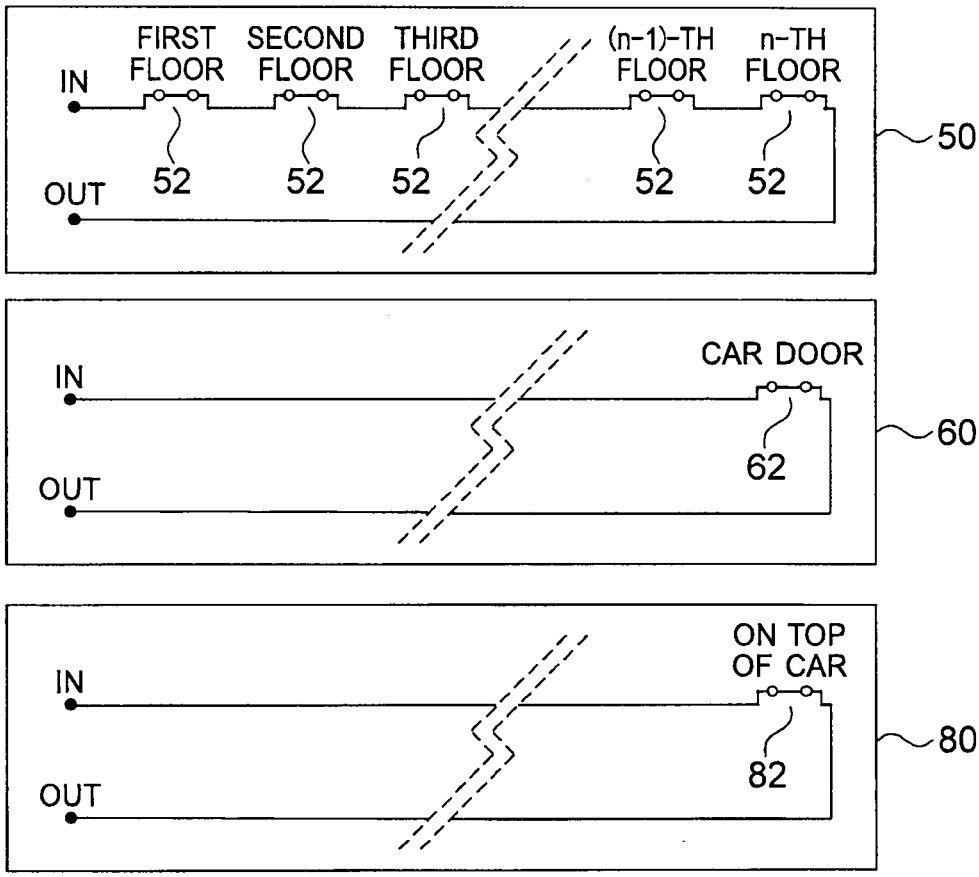
FIG. 9 is a circuit diagram illustrating the landing-door opening/closing detection device and the car-door opening/closing detection device illustrated in FIG. 1 and the door-zone detection device illustrated in FIG. 2.

FIG. 9 is a circuit diagram illustrating the landing-door opening/closing detection device 50 and the car-door opening/closing detection device 60 illustrated in FIG. 1 and the door-zone detection device 80 illustrated in FIG. 2. In the landing-door opening/closing detection device 50, the landing-door interlock switches 52 provided on all the stop floors are connected in series. When at least one of the landing-door interlock switches 52 is opened, the electric conduction between IN and OUT is interrupted.

When the car-door interlock switch 62 is opened in the car-door opening/closing detection device 60, the electric conduction between IN and OUT is interrupted. Further, the door-zone detection switch 82 is opened in the door-zone detection device 80, the electric conduction between IN and OUT is interrupted.

Figure 10:
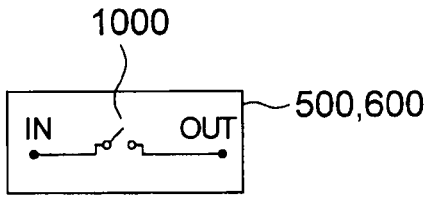
FIG. 10 is a circuit diagram illustrating a landing-side inspection device and a car-side inspection device illustrated in FIG. 1.

FIG. 10 is a circuit diagram illustrating the landing-side inspection device 500 and the car-side inspection device 600 illustrated in FIG. 1. Each of the landing-side inspection device 500 and the car-side inspection device 600 includes an inspection switch 1000 to be operated by the worker. The inspection switch 1000 is normally in a closed state. When the inspection switch 1000 is opened by the operation of the worker, the electric conduction between IN and OUT is interrupted.

The landing-side inspection device 500 and the car-side inspection device 600 are provided at positions that general users cannot easily touch, such as in a machine room or in a landing operating board, so as to prevent the running of the car 1 from being stopped by an operation performed by other than the worker. There may be adopted such a configuration that the landing-side inspection device 500 and the car-side inspection device 600 can be provided additionally only when the inspection work is performed.

Each of the operation controller 4 and the unintended car movement protection device 7 includes a microcomputer. Specifically, the function of each of the operation controller 4 and the unintended car movement protection device 7 can be realized by using the microcomputer.

The function of the unintended car movement protection device 7 can also be realized by an analog circuit.

Next, a method of inspecting the function of the unintended car movement protection device 7 is described. First, the worker stops the car 1 at a predetermined floor. After that, the inspection switch 1000 of the landing-side inspection device 500 is switched to be opened. The car 1 runs under the control in this state so as to confirm that the unintended car movement protection device 7 detects the running with the door open to stop the running of the car 1. Then, the inspection switch 1000 of the landing-side inspection device 500 is brought back to a closed state so as to stop the car 1 at the predetermined floor again.

Next, the inspection switch 1000 of the car-side inspection device 600 is switched to be opened. In this state, the car 1 runs under the control so as to confirm the unintended car movement protection device 7 detects the running with the door open to stop the running of the car 1. Then, the inspection switch 1000 of the car-side inspection device 600 is brought back to a closed state so as to bring the elevator apparatus back to a normal state.

In the elevator apparatus as described above, the landing-side inspection device 500 and the car-side inspection device 600 cause the unintended car movement protection device 7 to detect that at least any one of the landing doors 5 and the car door 6 is opened regardless of the actual states of the landing doors 5 and the car door 6 while the car 1 is running under the control of the operation controller 4. Therefore, it is not necessary to actually open the landing doors 5 and the car door 6 while the car 1 is running under the control. The inspection of the unintended car movement protection device 7 can be easily and efficiently performed.

Moreover, it is also possible to inspect whether or not the unintended car movement protection device 7 normally operates by opening the inspection switch 1000 while the car 1 is running under the control. Even in this case, it is not necessary to actually open the landing doors 5 and the car door 6. Therefore, the inspection of the unintended car movement protection device 7 can be easily and efficiently performed.

Further, even if the worker performs an erroneous operation, the unintended car movement protection device 7 is not allowed to recognize that the doors are closed when any one of the landing doors 5 and the car door 6 is actually open. Thus, the running with the door open due to the erroneous operation can be prevented.

Embodiment 2

Figure 11:
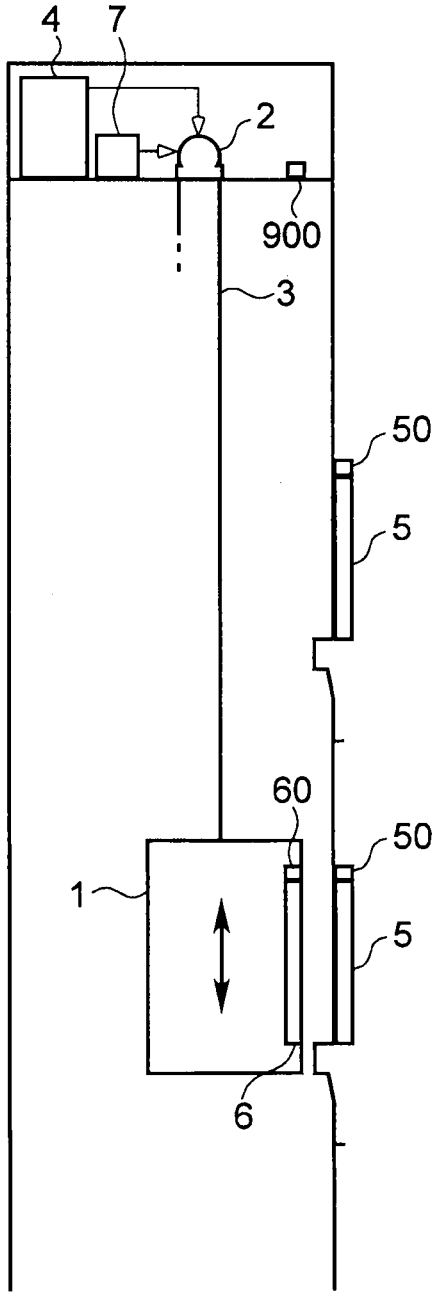
FIG. 11 is a schematic configuration diagram illustrating an elevator apparatus according to Embodiment 2 of the present invention.

Next, FIG. 11 is a schematic configuration diagram illustrating an elevator apparatus according to Embodiment 2 of the present invention. In FIG. 11, a function inspection device 900 corresponding to a safety-monitoring-function inspection section for inspecting the function of the unintended car movement protection device 7 is connected to the unintended car movement protection device 7.

Figure 12:
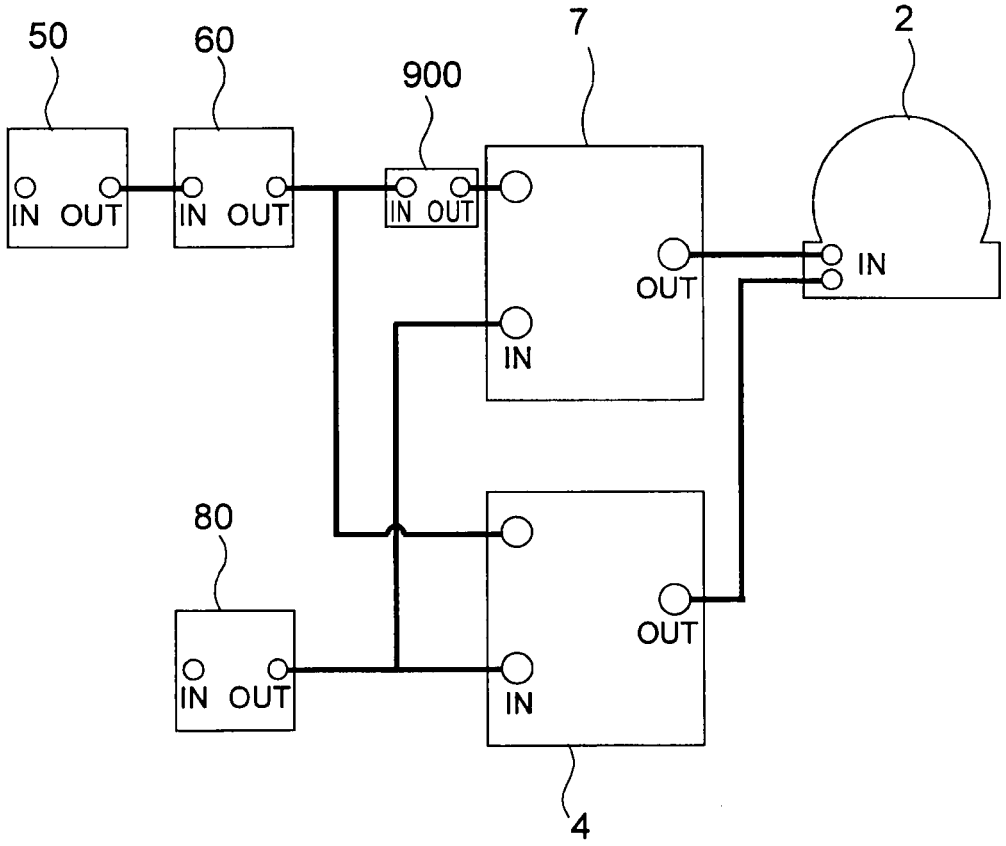
FIG. 12 is a wiring diagram illustrating a state in which devices are electrically connected in the elevator apparatus illustrated in FIG. 11.

FIG. 12 is a wiring diagram illustrating a state in which the devices are electrically connected in the elevator apparatus illustrated in FIG. 11. In FIG. 12, the landing-door opening/closing detection device 50 and the car-door opening/closing detection device 60 are connected in series. The unintended car movement protection device 7 is connected to the landing-door opening/closing detection device 50 and the car-door opening/closing detection device 60 through an intermediation of the function inspection device 900.

The function inspection device 900 is operated by the worker who carries out the inspection when the function of the unintended car movement protection device 7 is to be inspected. When being operated by the worker, the function inspection device 900 causes the unintended car movement protection device 7 to detect that at least one of the landing doors 5 and the car door 6 is opened regardless of the actual open/closed states of the landing doors 5 and the car door 6, that is, even though all the landing doors 5 and the car door 6 are closed.

Similarly to the landing-side inspection device 500 and the car-side inspection device 600 illustrated in FIG. 10, the function inspection device 900 includes the inspection switch 1000 to be operated by the worker. The function inspection device 900 is provided at the position that general users cannot easily touch, such as in the machine room or in the landing operating board, so as to prevent the running of the car 1 from being stopped by the operation performed by other than the worker. Alternatively, the configuration may allow the function inspection device 900 to be provided additionally. The remaining configuration is the same as that of Embodiment 1.

Next, a method of inspecting the function of the unintended car movement protection device 7 is described. First, the worker stops the car 1 at a predetermined floor. After that, the inspection switch 1000 of the function inspection device 900 is switched to be opened. The car 1 runs under the control in this state so as to confirm that the unintended car movement protection device 7 detects the running with the door open to stop the running of the car 1. Then, the inspection switch 1000 of the function inspection device 900 is brought back to a closed state so as to bring the elevator apparatus back to a normal state.

In the elevator apparatus as described above, the function inspection device 900 causes the unintended car movement protection device 7 to detect that at least any one of the landing doors 5 and the car door 6 is opened regardless of the actual states of the landing doors 5 and the car door 6 while the car 1 is running under the control of the operation controller 4. Therefore, it is not necessary to actually open the landing doors 5 and the car door 6 while the car 1 is running under the control. The inspection of the unintended car movement protection device 7 can be easily and efficiently performed.

Moreover, it is also possible to inspect whether or not the unintended car movement protection device 7 normally operates by opening the inspection switch 1000 while the car 1 is running under the control. Even in this case, it is not necessary to actually open the landing doors 5 and the car door 6. Therefore, the inspection of the unintended car movement protection device 7 can be easily and efficiently performed.

Further, in contrast to Embodiment 1, the landing-door opening/closing detection device 50 and the car-door opening/closing detection device 60 are connected in series. Therefore, the unintended car movement protection device 7 cannot distinguish the opening/closing of the landing doors 5 and that of the car door 6 from each other. However, the unintended car movement protection device 7 can detect that any one of the landing doors 5 and the car door 6 is opened. Thus, in contrast to Embodiment 1, the number of the devices to be added for the inspection work can be reduced to one (only the function inspection device 900 is to be provided). As a result, the number of steps of a work procedure can be reduced.

Embodiment 3

Figure 13:
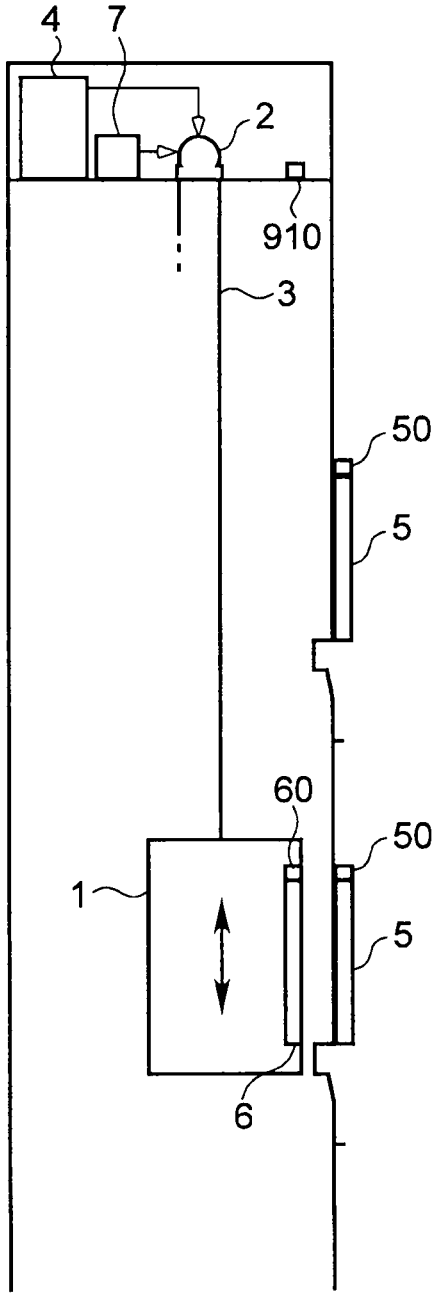
FIG. 13 is a schematic configuration diagram illustrating an elevator apparatus according to Embodiment 3 of the present invention.

Next, FIG. 13 is a schematic configuration diagram illustrating an elevator apparatus according to Embodiment 3 of the present invention. In FIG. 13, a function inspection device 910 corresponding to a safety-monitoring-function inspection section for inspecting the function of the unintended car movement protection device 7 is connected to the unintended car movement protection device 7.

Figure 14:
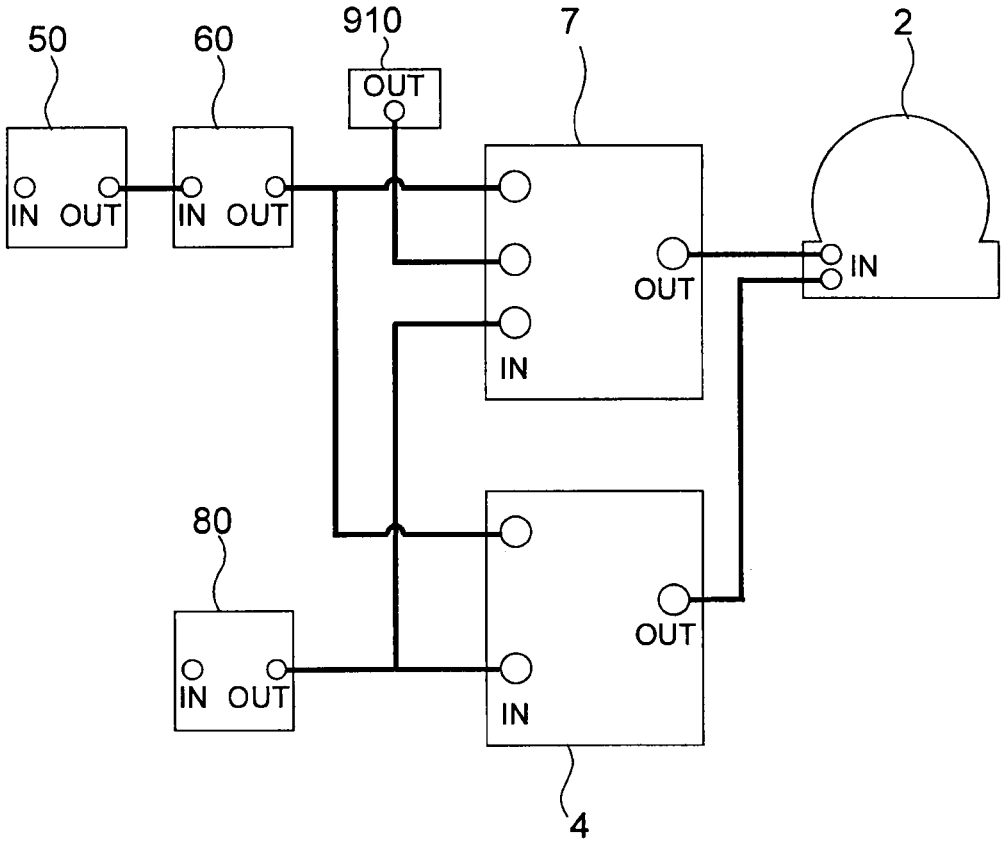
FIG. 14 is a wiring diagram illustrating a state in which devices are electrically connected in the elevator apparatus illustrated in FIG. 13.

FIG. 14 is a wiring diagram illustrating a state in which the devices are electrically connected in the elevator apparatus illustrated in FIG. 13. The function inspection device 900 according to Embodiment 2 is connected between the landing-door opening/closing detection device 50 and the car-door opening/closing detection device 60, and the unintended car movement protection device 7. However, the function inspection device 910 according to Embodiment 3 is connected to the unintended car movement protection device 7 separately from the landing-door opening/closing detection device 50 and the car-door opening/closing detection device 60.

The function inspection device 910 is operated by the worker who carries out the inspection when the function of the unintended car movement protection device 7 is to be inspected. When being operated by the worker, the function inspection device 910 causes the unintended car movement protection device 7 to detect that at least one of the landing doors 5 and the car door 6 is opened regardless of the actual open/closed states of the landing doors 5 and the car door 6, that is, even though all the landing doors 5 and the car door 6 are closed.

Specifically, when being operated by the worker, the function inspection device 910 according to Embodiment 3 outputs a door-open detection signal indicating that at least one of the landing doors 5 and the car door 6 is opened to the unintended car movement protection device 7. When the door-open detection signal is input from the function inspection device 910, the unintended car movement protection device 7 operates in the same manner as that in the case where at least one of the landing doors 5 and the car door 6 is opened.

More specifically, the function inspection device 910 outputs a Low signal (for example, at zero volt) during a normal operation and outputs a High signal (for example, at five volts) by an operation of the worker who carries out the inspection.

When the signal output from the function inspection device 910 is the Low signal indicating the normal operation, the unintended car movement protection device 7 detects the open/closed state of the car door based on information obtained from the landing-door opening/closing detection device 50 and the car-door opening/closing detection device 60.

When the signal output from the function inspection device 910 is the High signal indicating that the inspection is being performed, the unintended car movement protection device 7 determines that any one of the doors is open regardless of the information obtained from the landing-rood opening/closing detection device 50 and the car-door opening/closing detection device 60. Further, the unintended car movement protection device 7 realizes processing for determining that the door is open/closed based on the signal output from the function inspection device 910 and the signals output from the landing-door opening/closing detection device 50 and the car-door opening/closing detection device 60 by, for example, computation processing using an electronic circuit. The remaining configuration is the same as that of Embodiment 2.

Next, a method of inspecting the function of the unintended car movement protection device 7 is described. First, the worker stops the car 1 at a predetermined floor. After that, the function inspection device 910 is operated to input the door-open detection signal to the unintended car movement protection device 7. The car 1 runs under the control in this state so as to confirm that the unintended car movement protection device 7 detects the running with the door open to stop the running of the car 1. Then, the function inspection device 910 is brought back to the normal state so as to bring the elevator apparatus back to the normal state.

In the elevator apparatus as described above, the function inspection device 910 causes the unintended car movement protection device 7 to detect that at least any one of the landing doors 5 and the car door 6 is opened regardless of the actual states of the landing doors 5 and the car door 6 while the car 1 is running under the control of the operation controller 4. Therefore, it is not necessary to actually open the landing doors 5 and the car door 6 while the car 1 is running under the control. The inspection of the unintended car movement protection device 7 can be easily and efficiently performed.

Moreover, it is also possible to inspect whether or not the unintended car movement protection device 7 normally operates by operating the function inspection device 910 while the car 1 is running under the control. Even in this case, it is not necessary to actually open the landing doors 5 and the car door 6. Therefore, the inspection of the unintended car movement protection device 7 can be easily and efficiently performed.

Embodiment 4

Figure 15:
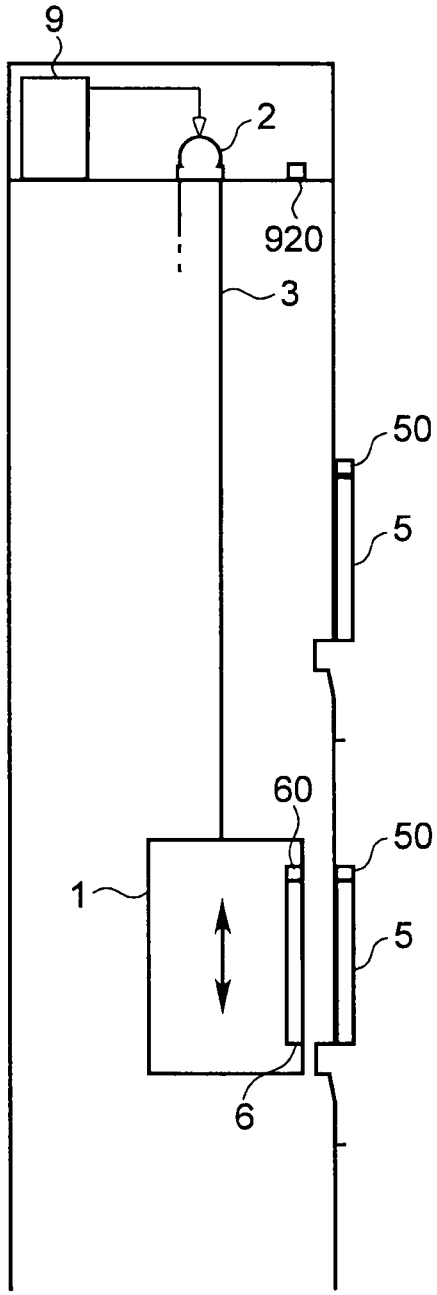
FIG. 15 is a schematic configuration diagram illustrating an elevator apparatus according to Embodiment 4 of the present invention.

Next, FIG. 15 is a schematic configuration diagram illustrating an elevator apparatus according to Embodiment 4 of the present invention. In FIG. 15, in the upper part of the hoistway, a controller 9 with protective function of preventing door-open running, which serves as the operation control section and the safety monitoring section, is provided. The controller 9 with protective function of preventing door-open running is obtained by integrating the operation controller 4 and the unintended car movement protection device 7 described in Embodiments 1 to 3, and therefore has the functions of the two.

An inspection-mode switching device 920 corresponding to a safety-monitoring-function inspection section for inspecting the protective function of preventing the door-open running of the controller 9 is connected to the controller 9 with protective function of preventing door-open running.

Figure 16:
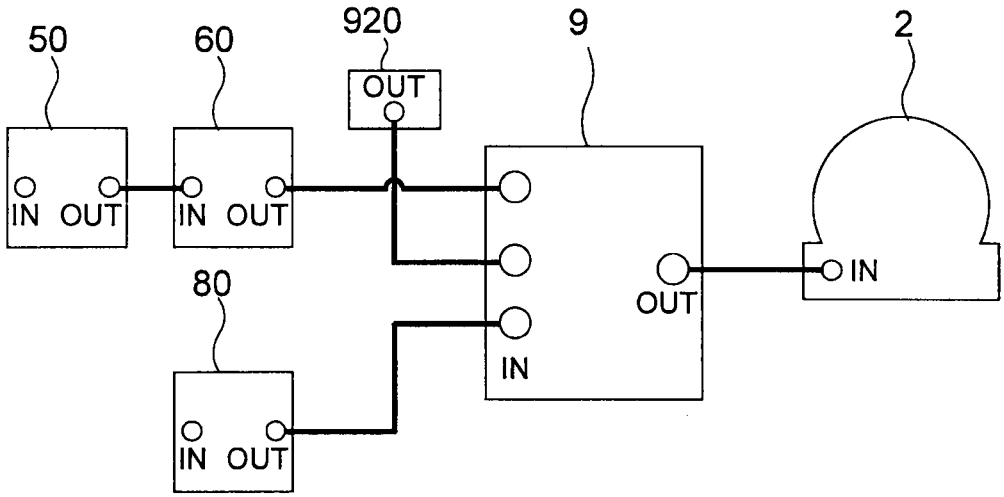
FIG. 16 is a wiring diagram illustrating a state in which devices are electrically connected in the elevator apparatus illustrated in FIG. 15.

FIG. 16 is a wiring diagram illustrating a state in which the devices are electrically connected in the elevator apparatus illustrated in FIG. 15. In FIG. 16, the controller 9 with protective function of preventing door-open running is connected to the landing-door opening/closing detection device 50 and the car-door opening/closing detection device 60 which are connected in series, the inspection-mode switching device 920, the door-zone detection device 80, and the hoisting machine 2. In this manner, the controller 9 with protective function of preventing door-open running is capable of detecting the open/closed states of the landing doors 5 and the car door 6 and the position of the car 1 (whether or not the car 1 is present within the door zone).

The controller 9 with protective function of preventing door-open running opens and closes the landing doors 5 and the car door 6 after confirming the presence of the car 1 within the door zone. Further, the controller 9 with protective function of preventing door-open running operates the hoisting machine 2 to allow the car 1 to run to a target floor after confirming the full closure of the landing doors 5 and the car door 6.

Further, when detecting that at least any one of the landing doors 5 and the car door 6 is open while the car 1 is present within the area out of the door zone, the controller 9 with protective function of preventing door-open running outputs a command for causing the hoisting-machine brake to perform the braking operation to the hoisting machine 2.

The inspection-mode switching device 920 is operated by the worker who carries out the inspection when the protective function of preventing door-open running is to be inspected. When being operated by the worker, the inspection-mode switching device 920 outputs an inspection-start signal indicating that the inspection has been started and a door-open detection signal indicating that the opening of at least one of the landing doors 5 and the car door 6 has been detected to the controller 9 with protective function of preventing door-open running.

When receiving the door-open detection signal from the inspection-mode switching device 920, the controller 9 with protective function of preventing door-open running detects that at least one of the landing doors 5 and the car door 6 is opened regardless of the actual open/closed states of the landing doors 5 and the car door 6, that is, even though all the landing doors 5 and the car door 6 are closed. When receiving the inspection-start signal, the controller 9 with protective function of preventing door-open running can start the running of the car 1 regardless of the open/closed states of the landing doors 5 and the car door 6.

More specifically, the inspection-mode switching device 920 outputs a Low signal (for example, at zero volt) during a normal operation and outputs a High signal (for example, at five volts) by an operation of the worker who carries out the inspection.

When the signal output from the inspection-mode switching device 920 is the Low signal indicating the normal operation, the controller 9 with protective function of preventing door-open running detects the open/closed state of the car door based on information obtained from the landing-door opening/closing detection device 50 and the car-door opening/closing detection device 60.

When the signal output from the inspection-mode switching device 920 is the High signal indicating that the inspection is being performed, the controller 9 with protective function of preventing door-open running can start the running of the car 1 regardless of the information obtained from the landing-door opening/closing detection device 50 and the car-door opening/closing detection device 60. At the same time, the controller 9 with protective function of preventing door-open running determines that any one of the doors is open.

Further, the controller 9 with protective function of preventing door-open running realizes processing for determining that the door is open/closed based on the signal output from the inspection-mode switching device 920 and the signals output from the landing-door opening/closing detection device 50 and the car-door opening/closing detection device 60 by, for example, computation processing using an electronic circuit. The remaining configuration is the same as that of Embodiment 3.

Next, a method of inspecting the protective function of preventing door-open running of the controller 9 with protective function of preventing door-open running is described. First, the worker stops the car 1 at a predetermined floor. After that, the inspection-mode switching device 920 is operated to input the inspection-start signal and the door-open detection signal to the controller 9 with protective function of preventing door-open running. The car 1 starts running under the control in this state so as to confirm that the controller 9 with protective function of preventing door-open running detects the running with the door open to stop the running of the car 1. Then, the inspection-mode switching device 920 is brought back to the normal state to bring the elevator apparatus back to the normal state.

In the elevator apparatus as described above, the inspection-mode switching device 920 causes the controller 9 with protective function of preventing door-open running to detect that at least any one of the landing doors 5 and the car door 6 is opened regardless of the actual states of the landing doors 5 and the car door 6 while the car 1 is running under the control of the controller 9 with protective function of preventing door-open running. Therefore, it is not necessary to actually open the landing doors 5 and the car door 6 while the car 1 is running under the control. The protective function of preventing door-open running of the controller 9 with protective function of preventing door-open running can be easily and efficiently inspected.

Moreover, it is also possible to inspect whether or not the protective function of preventing door-open running is normal by operating the inspection-mode switching device 920 while the car 1 is running under the control. Even in this case, it is not necessary to actually open the landing doors 5 and the car door 6. Therefore, the protective function of preventing door-open running can be easily and efficiently inspected.

Embodiment 5

Figure 17:
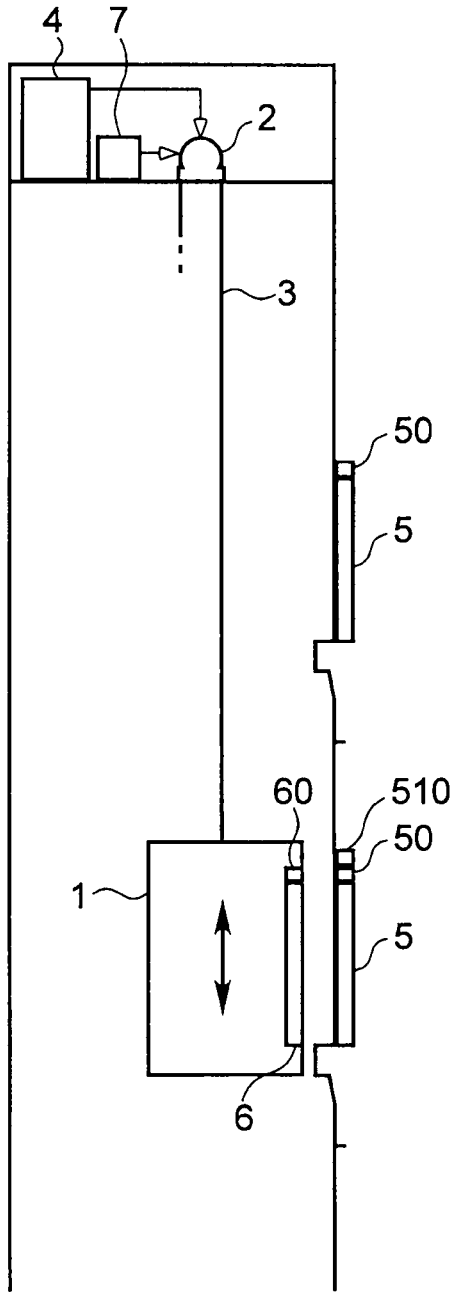
FIG. 17 is a schematic configuration diagram illustrating an elevator apparatus according to Embodiment 5 of the present invention.

Next, FIG. 17 is a schematic configuration diagram illustrating an elevator apparatus according to Embodiment 5 of the present invention. In FIG. 17, a landing-door interlock unlocking device 510 corresponding to a safety-monitoring-function inspection section and door-open recognition means for inspection, for inspecting the function of the unintended car movement protection device 7, is provided to one previously selected landing. The landing-door interlock unlocking device 510 forcibly drives and places the landing-door opening/closing detection device 50 into a door-open detection state.

Figure 18:
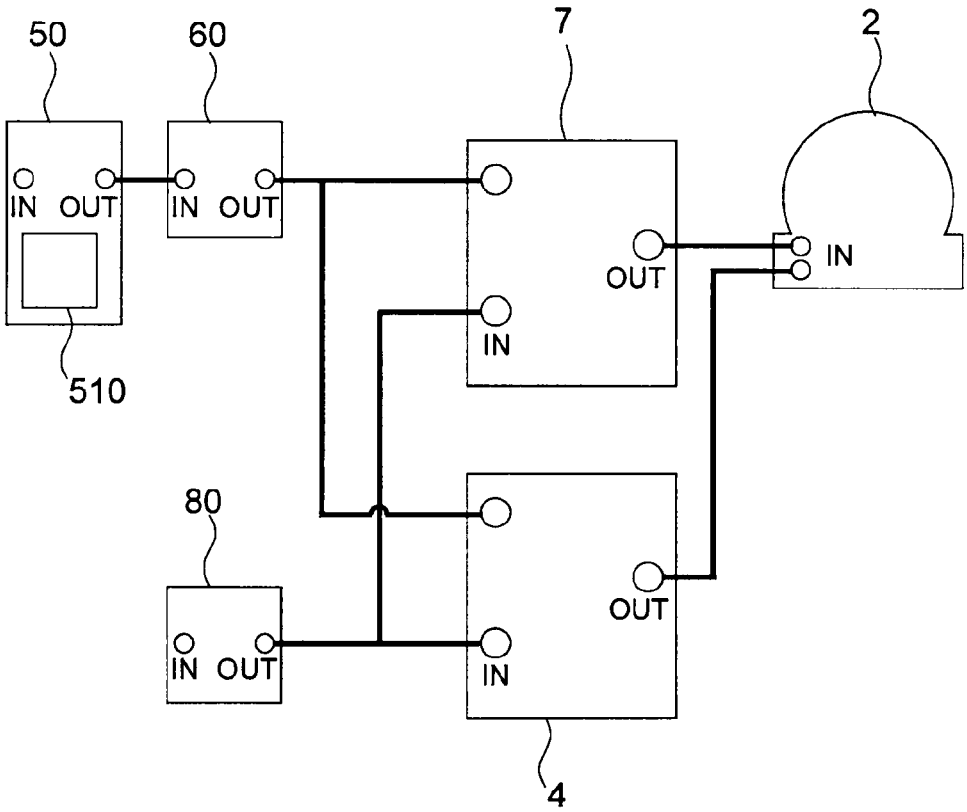
FIG. 18 is a wiring diagram illustrating a state in which devices are electrically connected in the elevator apparatus illustrated in FIG. 17.

FIG. 18 is a wiring diagram illustrating a state in which the devices are electrically connected in the elevator apparatus illustrated in FIG. 17. Differences from Embodiment 2 (FIG. 12) lie in that the function inspection device 900 is not provided between the car-door opening/closing detection device 60 and the unintended car movement protection device 7 and that the landing-door interlock unlocking device 510 is provided to the landing-door opening/closing detection device 50.

The landing-door interlock unlocking device 510 is operated by the worker who carries out the inspection when the function of the unintended car movement protection device 7 is to be inspected. When being operated by the worker, the landing-door interlock unlocking device 510 causes the unintended car movement protection device 7 to detect that one of the landing doors 5 is opened regardless of the actual open/closed states of the landing doors 5, that is, even though all the landing doors 5 are closed. In this manner, the function of the unintended car movement protection device 7 can be confirmed without actually opening the landing doors 5 while the car 1 is running under the control.

Figure 19:
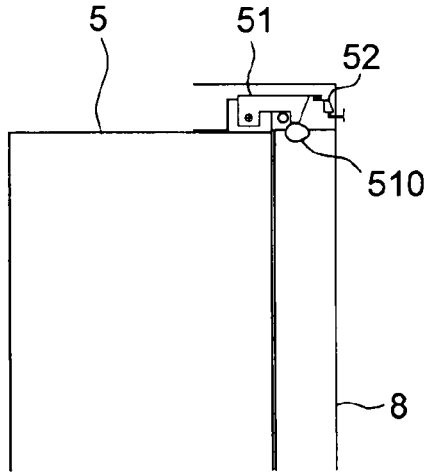
FIG. 19 is a front view illustrating a landing-door interlock unlocking device illustrated in FIG. 17.
Figure 20:
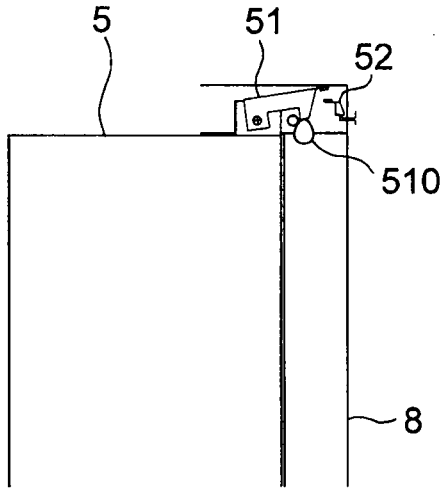
FIG. 20 is a front view illustrating a state in which a protective function of preventing door-open running of the landing-door interlock unlocking device illustrated in FIG. 19 is inspected.

FIG. 19 is a front view illustrating the landing-door interlock unlocking device 510 illustrated in FIG. 17, and FIG. 20 is a front view illustrating a state in which the protective function of preventing door-open running of the landing-door interlock unlocking device 510 illustrated in FIG. 19 is inspected. The landing-door interlock unlocking device 510 includes a disc cam which is rotatable in contact with the landing-door lock mechanism 51. By rotating the disc cam manually or with a driving force of a motor or the like, the landing-door lock mechanism 51 is turned as illustrated in FIG. 20 to forcibly open the landing-door interlock switch 52. The remaining configuration is the same as that of Embodiment 2.

The used disc cam of the landing-door interlock unlocking device 510 has such a size that the landing-door lock mechanism 51 is not completely unlocked and the landing-door interlock switch 52 is opened. This is for preventing the landing door 5 from being unintentionally opened by the operation of the landing-door interlock unlocking device 510.

Next, a method of inspecting the function of the unintended car movement protection device 7 is described. First, the worker causes the car 1 to run. Thereafter, the landing-door interlock unlocking device 510 is operated to forcibly open the landing-door interlock switch 52 so as to confirm that the unintended car movement protection device 7 detects the running with the door open to stop the running of the car 1. Then, the landing-door interlock unlocking device 510 is brought back to the original state to bring the elevator apparatus back to the normal state.

In the elevator apparatus as described above, the landing-door interlock unlocking device 510 causes the unintended car movement protection device 7 to detect that one of the landing doors 5 is opened regardless of the actual states of the landing doors 5 while the car 1 is running under the control of the operation controller 4. Therefore, it is not necessary to actually open the landing doors 5 and the car door 6 while the car 1 is running under the control. The inspection of the unintended car movement protection device 7 can be easily and efficiently performed.

Although the landing-door interlock unlocking device 510 using the disc cam is described in Embodiment 5, the door-open recognition means for inspection is not limited thereto and may use, for example, a wire, a link mechanism, or a ball screw. The door-open recognition means for inspection can also be realized by a structure capable of driving the landing-door lock mechanism 51 with a key conventionally used for unlocking the landing door.

Although the door-zone detection switch 82 is mounted to the car 1 in Embodiments 1 to 5, a plurality of door-zone detection switches may be provided to the hoistway side, whereas an operating piece for operating the door-zone detection switches may be mounted to the car 1.

Further, the door-zone detection device (car-position detection means) is not limited to that for mechanically operating the door-zone detection switch 82 and may use, for example, an optical sensor or a magnetic sensor.

Further, the inspection switch 1000 described in Embodiments 1 and 2, the function inspection device 910 described in Embodiment 3, the inspection-mode switching device 920 described in Embodiment 4, and the landing-door interlock unlocking device 510 described in Embodiment 5 may be configured so as to be operated by an operation performed at a remotely located place such as a service station. As a result, the inspection can be carried out without sending the worker to a work site to reduce the number of items to be inspected by the worker at the work site.

Although the operation controller 4, the unintended car movement protection device 7, and the controller 9 with protective function of preventing door-open running are provided in the upper part of the hoistway in Embodiments 1 to 5, the locations where the above-mentioned devices are provided are not particularly limited. The present invention is also applicable to a machine-room-less elevator.

Further, the location where the hoisting machine 2 is located, the number of the hoisting machines 2, a roping method, and the number of the cars 1 are not particularly limited. The present invention is applicable to any types of elevator apparatus.

Further, although the running with the door open has been described as the abnormal state to be detected by the safety monitoring section in Embodiments 1 to 5, the targets to be monitored are not limited to the elevator doors. Moreover, the abnormal state is not limited to the running with the door open.

As the abnormal states other than the running with the door open, for example, overspeed running and a terminal-landing overrun operation can be given.

When the safety monitoring section for monitoring the occurrence of the overspeed running among the above-mentioned abnormal states is to be inspected, the safety-monitoring-function inspection section simulates a state in which the safety monitoring section detects the occurrence of the abnormality even while the car is running at a normal speed by, for example, setting a reference speed for determining the overspeed running lower than a normal reference speed.

When the safety monitoring section for monitoring the occurrence of the terminal-landing overrun operation is to be inspected, the safety-monitoring-function inspection section simulates a state in which the terminal-landing overrun is detected without bringing the car into contact with a terminal-landing overrun detection switch by, for example, remotely operating the terminal-landing overrun detection switch to be operated by the car in the case where the car runs through the terminal landing.

The invention claimed is:

1. An elevator apparatus, comprising:

a car;

an operation control section for controlling an operation of the car;

a safety monitoring section for detecting an abnormal state of targets to be monitored during running of the car to stop the running of the car; and a safety-monitoring-function inspection section for inspecting a function of the safety monitoring section, wherein:

the safety monitoring section has a function of stopping the running of the car when at least one of a plurality of elevator doors corresponding to the targets to be monitored is open; and the safety-monitoring-function inspection section causes the safety monitoring section to detect that at least one of the elevator doors is opened even though all the elevator doors are closed while the car is running under the control of the operation control section.

2. The elevator apparatus according to claim 1, further comprising a plurality of door switches, each being opened when a corresponding one of the elevator doors is open and being closed when the corresponding one of the elevator doors is closed, wherein:

the safety monitoring section is connected to the door switches; and the safety-monitoring-function inspection section includes an inspection switch for interrupting electric conduction between the door switches and the safety monitoring section.

3. The elevator apparatus according to claim 1, further comprising:

opening/closing detection means for detecting opening/closing of the elevator doors; and car-position detection means for detecting whether or not the car is present within a door zone in which the elevator doors are allowed to be opened, wherein the safety monitoring section is connected to the opening/closing detection means, the car-position detection means, and the safety-monitoring-function inspection section, and stops the running of the car in a case where at least one of the elevator doors is open when the car is present within an area out of the door zone.

4. The elevator apparatus according to claim 3, wherein:

the opening/closing detection means includes a plurality of door switches, each being opened when a corresponding one of the elevator doors is open and being closed when the corresponding one of the elevator doors is closed; and the safety-monitoring-function inspection section includes an inspection switch for interrupting electric conduction between the door switches and the safety monitoring section.

5. An elevator apparatus comprising:

a car;

opening/closing detection means for detecting opening/closing of landing doors;

an unintended car movement protection device connected to the opening/closing detection means, for stopping running of the car when detecting the running of the car with at least any one of the landing doors open; and door-open recognition means for inspection, for causing the unintended car movement protection device to detect that at least one of the landing doors is opened during the running of the car even though all the landing doors are closed.

6. A method of inspecting an elevator apparatus comprising:

a car;

an operation control section for controlling an operation of the car; and an unintended car movement protection device, for stopping running of the car when at least any one of elevator doors is open, the method comprising causing the unintended car movement protection device to detect with a safety-monitoring-function inspection section that at least one of the elevator doors is opened in a state in which all the elevator doors are closed while the car is running under control of the operation control section.

* * * * *